United States Patent [19]

Meador

[11] Patent Number: 4,929,345

[45] Date of Patent: May 29, 1990

[54] CARPET SWEEPER

[76] Inventor: Hilman J. Meador, 2712 Dick Taylor St., Monroe, La. 71202-3216

[21] Appl. No.: 375,883

[22] Filed: Jul. 6, 1989

[51] Int. Cl.[5] ..... B03C 1/30

[52] U.S. Cl. ..... 209/215; 15/47; 15/105; 15/160; 209/614; 209/229

[58] Field of Search ..... 209/215, 614, 229; 15/323, 339, 47, 344, 367, 4, 105, 160; 294/65.5

[56] References Cited

U.S. PATENT DOCUMENTS

| | | | |
|---|---|---|---|
| 2,677,461 | 5/1954 | Bodey | 15/339 |
| 3,377,641 | 4/1968 | McGregor | 209/215 |
| 4,087,879 | 5/1978 | Spence | 209/215 |
| 4,107,808 | 8/1978 | Schroder | 15/47 X |
| 4,172,597 | 10/1979 | Smith et al. | 294/65.5 X |
| 4,407,038 | 10/1983 | Haase | 209/215 X |
| 4,598,439 | 7/1986 | Good | 209/215 X |
| 4,683,607 | 8/1987 | Lackner et al. | 15/323 |
| 4,765,012 | 8/1988 | Ueda | 15/47 X |

*Primary Examiner*—Donald T. Hajec

*Attorney, Agent, or Firm*—Brady, O'Boyle & Gates

[57] ABSTRACT

A carpet sweeper for removing metallic staples, paper clips and the like from carpet wherein a semi-circular wire mesh fabric is secured to the forward end of a housing or base member and a magnet is secured to the bottom of the base member and extends along the trailing edge of the wire mesh fabric. The wire mesh fabric dislodges the metallic fasteners from the carpet and the magnet attracts and accumulates the dislodged fasteners. A scraper is removably mounted on the housing for removing the accumulated fasteners from the surface of the magnet, and a rod having a slotted magnetic end is provided for manually removing deeply embedded metallic fasteners from the carpet.

9 Claims, 2 Drawing Sheets

FIG. 1
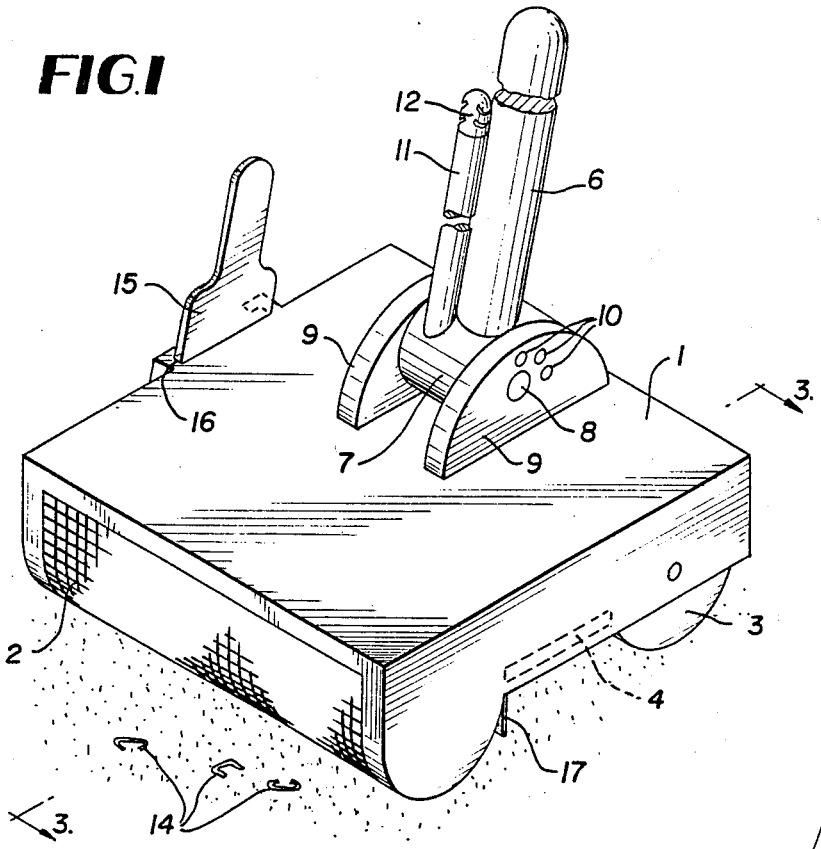
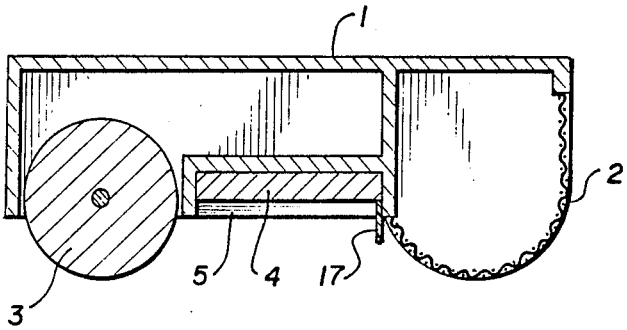
FIG. 3
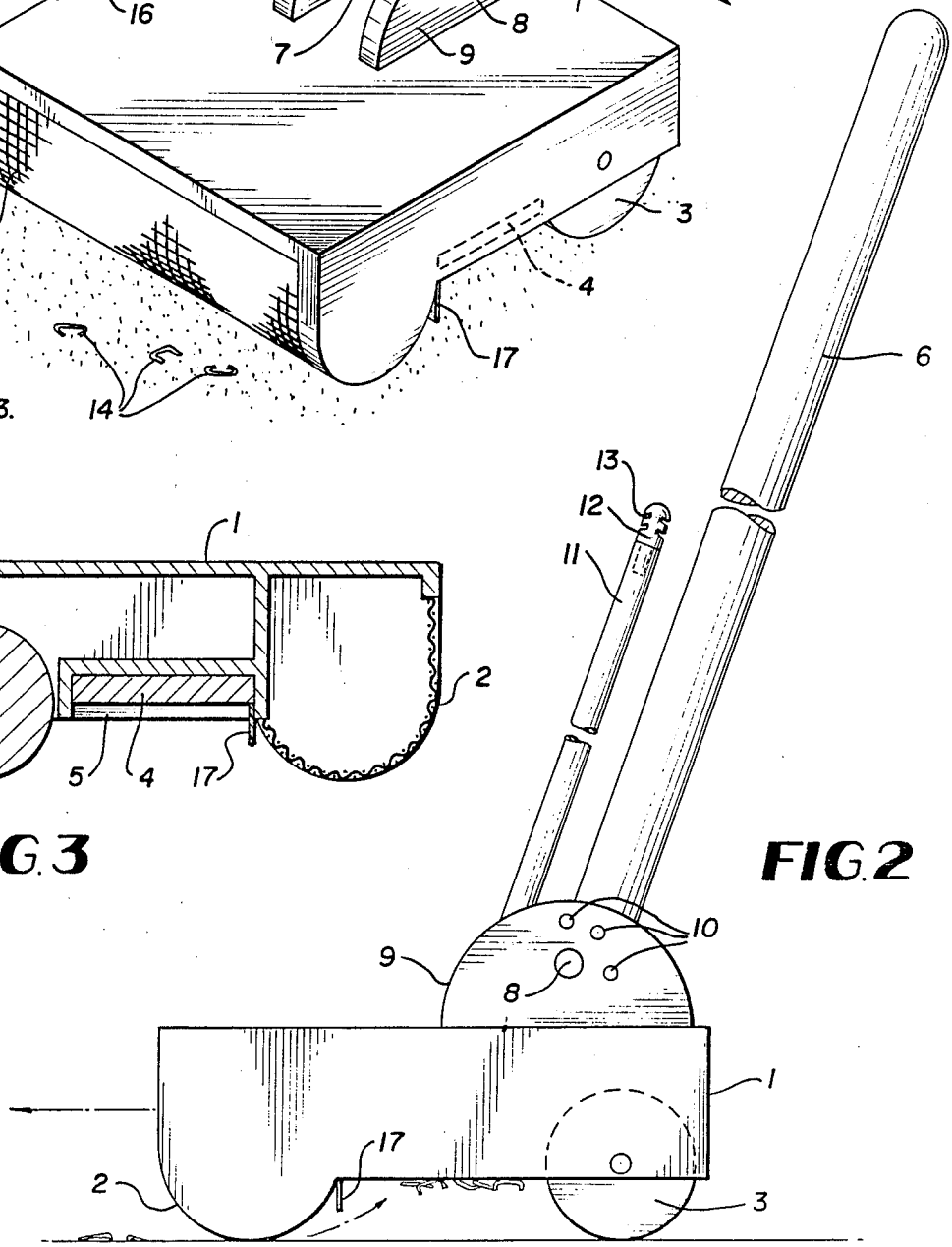
FIG. 2

FIG. 4
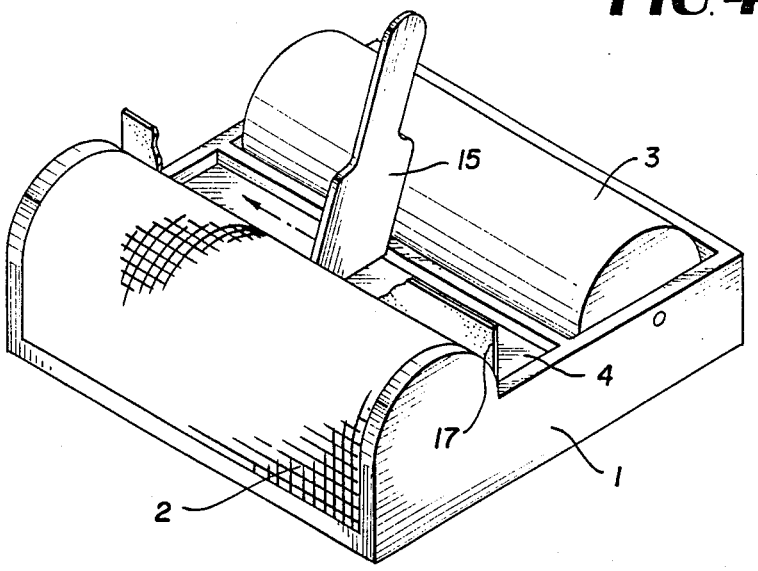
FIG. 5
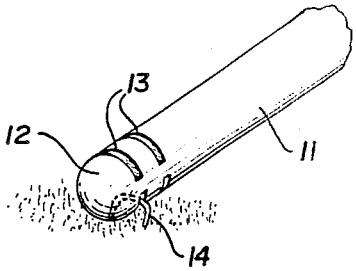
FIG. 6
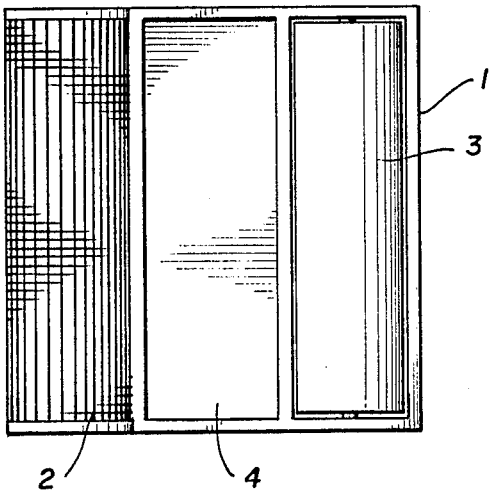
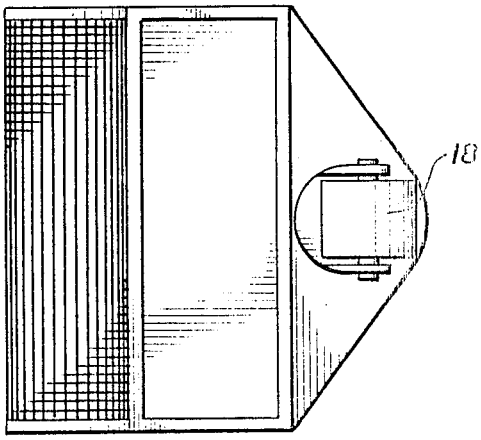
FIG. 7

CARPET SWEEPER

BACKGROUND OF THE INVENTION

Considerable difficulty has been experienced in the removal of staples, paper clips and the like from carpets, particularly from carpets in offices where these metallic fastening devices fall in the normal course of the activities in the office. These metallic fasteners, particularly staples, tend to become embedded or caught in the pile of the carpeting to such an extent that even a strong, commercial vacuum cleaner cannot dislodge them.

In order to facilitate the removal of staples, paper clips and other similar metallic fasteners embedded or caught in carpeting, the carpet sweeper of the present invention has been devised which comprises, essentially, a housing or base member having a semi-cylindrical wire mesh fabric on the forward end of the housing and a wheel on the rear end thereof. A magnet is mounted on the base member between the mesh fabric and the wheel and a handle is connected to the base member for manually pushing the sweeper over the carpet. By this construction and arrangement, the wire mesh fabric first pulls or dislodges the metallic fasteners from the carpet to thereby facilitate the attraction of the fasteners against the surface of the magnet.

While magnetic floor sweepers have been proposed, as disclosed in U.S. Pat. No. 2,426,795, wherein a magnet is mounted on a wheeled frame for picking up metallic debris from a floor, these types of sweepers are not satisfactory for removing metallic articles embedded or entangled in carpet piling since the magnetic force is not sufficient to dislodge the debris from the carpet.

The carpet sweeper of the present invention combines the mechanical action of the wire mesh fabric to first pull or dislodge the metallic fastener from the carpet, and the magnetic force of the magnet to attract the fastener away from the carpet.

BRIEF DESCRIPTION OF THE DRAWINGS

FIG. 1 is a perspective view of the carpet sweeper of the present invention;

FIG. 2 is a side elevational view of the carpet sweeper shown in FIG. 1;

FIG. 3 is a view taken along line 3—3 of FIG. 1

FIG. 4 is a perspective view of the bottom of the sweeper illustrating the manner in which the accumulated metallic fasteners are removed from the magnet:

FIG. 5 is a fragmentary perspective view of an accessory provided with the sweeper to facilitate the removal of fasteners deeply embedded in the carpet:

FIG. 6 is a bottom plan view of the sweeper shown in FIG. 4: and

FIG. 7 is a bottom plan view of another embodiment of the sweeper.

DESCRIPTION OF THE PREFERRED EMBODIMENT

Referring to the drawings, and more particularly to FIGS. 1 to 3, the carpet sweeper of the present invention comprises, a base member or housing 1 having a fixed, rigid, semi-circular wire mesh fabric 2 secured to the front of the housing 1 and a roller type wheel 3 mounted on the rear of the housing. A permanent magnet 4, extending the width of the base member, is mounted within a recess 5 provided in the bottom of the housing 1 between the wire mesh fabric 2 and the roller 3.

The sweeper is provided with a handle 6 having a hub member 7 at its lower end. Each end of the hub member 7 has a pin portion 8 journaled in a respective bracket member 9 secured to the top of the housing 1, whereby the handle is pivotally connected to the housing. Detent members 10 are provided between one of the bracket members 9 and the hub member 7 so that the handle can be maintained in a desired inclined position relative to the housing 1.

To facilitate the removal of metallic fasteners which might be deeply embedded into the carpet, a rod 11 is provided having a magnetic member 12 on one end thereof. The magnetic member 12 is provided with a plurality of slots 13 for receiving a fastener 14, as shown in FIG. 5, whereby the fastener can be manually lifted from the carpet. When not in use, the rod 11 is inserted into a bore provided in the hub member 7, as shown in FIGS. 1 and 2.

To remove accumulated fasteners from the magnet 4, to be described more fully hereinafter, a scraper 15, FIG. 1, is removably mounted in a recess 16 provided on the side of the housing 1, and a baffle 17 is provided between the trailing edge of the wire mesh fabric 2 and the leading edge of the magnet 4, to thereby prevent the accumulated fasteners from becoming entangled with the fabric 2 while being scraped from the magnet 4, as shown in FIG. 4.

In use, the carpet sweeper is pushed on the carpet in a direction so that the wire mesh fabric 2 engages the carpet in a tangential manner, as shown in FIG. 2, to thereby engage the metallic fasteners or staples 14 in the carpet. The mechanical action between the wire mesh fabric 2 and the staples 14 loosens the hold of the staples from the carpet so that continued movement of the sweeper will result in the loose staples being attracted to and accumulating on the magnet 4. After the sweeping action has been completed, the scraper 15 is employed for removing the accumulated staples from the magnet, as shown in FIG. 4.

To remove deeply embedded metallic fasteners for subsequent pick-up by the magnet 4, the rod 11 is employed as described hereinabove.

While the carpet sweeper of the present invention has been described as having a roller 3 on the trailing end of the housing 1 to facilitate the travel of the sweeper over the carpet, a caster-type wheel 18, as shown in FIG. 7, might be employed in lieu of the roller 3. Furthermore, if ease of travel of the sweeper over the carpet is not deemed important, it is contemplated that in lieu of the wheels, a second semicircular wire mesh fabric can be mounted on the trailing end of the housing.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A carpet sweeper comprising a base member, a wire mesh fabric secured to the forward end of said base member and engaging the surface of the carpet to be swept, magnetic means secured to the bottom of the base member adjacent the wire mesh fabric, handle means secured to the base member to thereby facilitate the manual pushing of the sweeper over the carpet to be cleaned, whereby the mechanical action of the wire mesh fabric dislodges metallic fasteners caught in the carpet, and the magnetic force of the magnet attracts and accumulates the dislodged fasteners away, from the carpet, and a scraper attachably connected to the base member for manually removing accumulated metallic fasteners from the magnetic means.

2. A carpet sweeper according to claim 1, wherein the wire mesh fabric is semi-circular and engages the carpet in a tangential manner.

3. A carpet sweeper according to claim 1, wherein the magnetic means comprises a permanent magnet extending along the width of the base member adjacent the trailing edge of the wire mesh fabric.

4. A carpet sweeper according to claim 1, wherein a baffle is mounted on the bottom of the base member between the wire mesh fabric and the magnetic means to prevent the accumulated metallic fasteners from becoming entangled with the wire mesh fabric while being scraped from the magnetic means.

5. A carpet sweeper according to claim 1, wherein a rod having a magnetic member on one end thereof is detachably mounted on the base member, said magnetic member having a plurality of slots, whereby metallic fasteners which are deeply embedded in the carpet are manually removed by inserting the slotted magnetic end of the rod over a fastener and pulling the fastener out of the carpet.

6. A carpet sweeper according to claim 1, wherein wheel means are mounted on the bottom of the base member adjacent the rear end thereof.

7. A carpet sweeper according to claim 6, wherein the wheel means comprises a roller extending the width of the base member.

8. A carpet sweeper according to claim 6, wherein the wheel means comprises a caster wheel.

9. A carpet sweeper comprising a base member, a wire mesh fabric secured to the forward end of said base member and engaging the surface of the carpet to be swept, magnetic means secured to the bottom of the base member adjacent the wire mesh fabric, handle means secured to the base member to thereby facilitate the manual pushing of the sweeper over the carpet to be cleaned, whereby the mechanical action of the wire mesh fabric dislodges metallic fasteners caught in the carpet, and the magnetic force of the magnet attracts and accumulates the dislodged fasteners away from the carpet, and a rod having a magnetic member on one end thereof detachably mounted on the base member, said magnetic member having a plurality of slots, whereby metallic fasteners which are deeply embedded in the carpet are manually removed by inserting the slotted magnetic end of the rod over a fastener and pulling the fastener out of the carpet.

* * * * *